US009868626B2

(12) United States Patent
Ench

(10) Patent No.: US 9,868,626 B2
(45) Date of Patent: Jan. 16, 2018

(54) BEVERAGE DISPENSER

(71) Applicant: Grindmaster Corporation, Louisville, KY (US)

(72) Inventor: Robert Michael Ench, Louisville, KY (US)

(73) Assignee: Grindmaster Corporation, Louisville, KY (US)

( * ) Notice: Subject to any disclaimer, the term of this patent is extended or adjusted under 35 U.S.C. 154(b) by 0 days.

(21) Appl. No.: 15/133,754

(22) Filed: Apr. 20, 2016

(65) Prior Publication Data

US 2016/0304331 A1 Oct. 20, 2016

Related U.S. Application Data

(60) Provisional application No. 62/150,099, filed on Apr. 20, 2015, provisional application No. 62/150,390, filed on Apr. 21, 2015.

(51) Int. Cl.
*B67D 3/00* (2006.01)
*B67D 3/04* (2006.01)

(52) U.S. Cl.
CPC ..... *B67D 3/0061* (2013.01); *B67D 3/0025* (2013.01); *B67D 3/0083* (2013.01); *B67D 3/00* (2013.01); *B67D 3/043* (2013.01)

(58) Field of Classification Search
CPC .. B67D 3/0061; B67D 3/0025; B67D 3/0083; B67D 3/00; B67D 3/043; B65D 2231/00
See application file for complete search history.

(56) References Cited

U.S. PATENT DOCUMENTS 1,832,798 A * 11/1931 Taylor ..... A47J 41/0072 220/DIG. 1
3,269,606 A * 8/1966 Armstrong ..... F25D 31/002 141/360
4,008,832 A * 2/1977 Rodth ..... B67D 1/0861 222/129.1
4,133,452 A * 1/1979 Wiltrout ..... A01K 97/04 124/27

(Continued)

FOREIGN PATENT DOCUMENTS

WO 2006043246 A1 4/2006

OTHER PUBLICATIONS

Korean Intellectual Property Office, International Search Report issued in corresponding Application No. PCT/US2016/ 028378, dated Jul. 28, 2016.

*Primary Examiner* — Frederick C Nicolas
(74) *Attorney, Agent, or Firm* — Stites & Harbison, PLLC; David W. Nagle, Jr.; James R. Hayne

(57) ABSTRACT

A beverage dispenser includes a lower base, an upper receptacle positioned on and above the lower base for storing a beverage, and a valve in fluid communication with the beverage stored in the upper receptacle. The valve is seated within an opening defined through a bottom panel of the upper receptacle, extends downward from the upper receptacle, and is biased into a closed position. A handle engages the valve, such that rotation of the handle causes the handle to move the valve from the closed position to an open position where the beverage is dispensed through the valve. At the same time, the handle (and the valve) can be readily installed on or removed from the beverage dispenser.

11 Claims, 5 Drawing Sheets

(56) References Cited

U.S. PATENT DOCUMENTS

| | | | | | |
|---|---|---|---|---|---|
| 4,505,409 | A * | 3/1985 | Armstrong | B67D 3/00 | 137/315.37 |
| 4,765,152 | A * | 8/1988 | Armstrong | B67D 3/0009 | 222/146.6 |
| 4,958,505 | A * | 9/1990 | Swanson | B67D 1/0857 | 222/146.6 |
| 5,019,690 | A * | 5/1991 | Knepler | A47J 27/21008 | 219/400 |
| 5,142,610 | A * | 8/1992 | Augustine | A47J 31/54 | 222/146.5 |
| 5,209,069 | A * | 5/1993 | Newnan | B01F 13/0827 | 222/146.6 |
| 5,564,601 | A * | 10/1996 | Cleland | B67D 1/0054 | 165/164 |
| 6,708,741 | B1 * | 3/2004 | Berry | B67D 3/0009 | 141/351 |
| 6,889,598 | B2 * | 5/2005 | Wroblewski | A47J 31/441 | 99/275 |
| 2003/0071066 | A1 | 4/2003 | Nowak et al. | | |
| 2009/0308492 | A1 | 12/2009 | Benvenuto et al. | | |
| 2013/0213493 | A1 | 8/2013 | Samson | | |
| 2015/0315007 | A1 | 11/2015 | Wongsa | | |

* cited by examiner

BEVERAGE DISPENSER

CROSS-REFERENCE TO RELATED APPLICATIONS

The present application claims priority to U.S. Patent Application Ser. No. 62/150,099 filed on Apr. 20, 2015 and U.S. Patent Application Ser. No. 62/150,390 filed on Apr. 21, 2015, the entire disclosures of which are incorporated herein by reference.

BACKGROUND OF THE INVENTION

The present invention relates to beverage dispensers, for example, tea urns, for holding a volume of beverage within a receptacle and then dispensing that beverage to a consumer through a valve. In this regard, there are various types of beverage dispensers in the industry. In many of these known beverage dispensers, the valve or similar dispensing means is located on the side of the beverage dispenser and is raised above the bottom of the beverage dispenser, so that a cup or other receptacle can be placed next to the beverage dispenser below the valve when the beverage is dispensed. In order to dispense the beverage, a user must typically pull or manipulate a handle located above the valve, which can, in some instances, require the use of both of the user's hands—one to hold the cup or other receptacle and the other to pull or manipulate the handle. Furthermore, with the valve extending horizontally from the side of the beverage dispenser it is typical that not all of the beverage stored in the beverage dispenser is capable of being dispensed, since a portion of the beverage is retained below the outlet for the valve.

SUMMARY OF THE INVENTION

The present invention is a beverage dispenser that has a dispenser valve extending from the bottom of an upper receptacle and a handle for engaging and activating the valve, a handle that can be readily installed on or removed from the beverage dispenser.

An exemplary beverage dispenser made in accordance with the present invention comprises: a lower base; an upper receptacle positioned on and above the lower base, the upper receptacle for storing a beverage; and a removable lid for closing an open top of the upper receptacle. More specifically, the upper receptacle includes a bottom panel, and the lower base is positioned below the bottom panel of the upper receptacle. The top surface of the lower base is substantially coplanar to and coextensive with the bottom panel of the upper receptacle, except along a front portion of the upper receptacle. In other words, the front portion of the upper receptacle extends forward of the lower base. The beverage dispenser further includes a front cover that is forward of the lower base along the perimeter of the front portion of the upper receptacle. Thus, the front cover partially encloses and defines a cavity that is located below the bottom panel of the upper receptacle and forward of the lower base.

The beverage dispenser further includes a valve which is in fluid communication with the beverage stored in the upper receptacle and extends from the bottom panel of the upper receptacle substantially within the cavity and adjacent to the lower base. The beverage dispenser also includes a handle for engaging the valve to selectively dispense the beverage from the upper receptacle. In operation, the valve is biased into a closed (downward) position, such that the beverage is maintained in the upper receptacle. Upon moving the valve upward into an open position, beverage that is stored in the upper receptacle is dispensed through the valve.

The handle includes a main body plate that includes two engagement tabs and a central slot that is located between the two engagement tabs which is configured to receive the valve. The two engagement tabs of the handle are slidably received by two slots defined by the front cover, and the valve is received in and engages the central slot defined by the main body plate. Specifically, the valve has a distal end that extends through the central slot defined by the main body plate, and the valve further includes a circumferential flange which is positioned above the main body plate when the valve is received in the central slot defined by the main body plate. In operation, the main body plate of the handle engages the circumferential flange of the valve to push the valve upward into the open position, such that beverage that is stored in the upper receptacle is dispensed through the valve.

In order to dispense the beverage, a user causes the main body plate of the handle to rotate upward toward the upper receptacle. To this end, the handle further includes a rear vertical plate that extends downward from a rear end of the main body plate and also a forward push button that extends upward from a front end of the main body plate. Applying a rearward force to the vertical plate, or, alternatively, applying a downward force to the push button, causes the handle to rotate in such a manner that the main body plate rotates upward toward the upper receptacle.

With respect to the rotation of the handle, the two engagement tabs of the handle and the respective two slots defined by the front cover are configured to allow the handle to rotate relative to the front cover to engage the valve. Specifically, the contact points between the two engagement tabs and the two slots act as a pivot for the handle to rotate about an axis generally defined by the intersection of the main body plate of the handle and the front cover.

Finally, in at least some embodiments, the bottom panel of the upper receptacle is shaped to direct all of the beverage stored in the upper receptacle toward the opening. Specifically, the bottom panel is sloped downward toward the front of the upper receptacle. Furthermore, the bottom panel defines a channel along the center of the bottom panel that is directed toward the opening, which further facilitates in dispensing the entire volume of beverage stored in the upper receptacle. As a result of the unique shape of the bottom panel of the upper receptacle, along with the placement of the valve extending from the bottom panel of the upper receptacle, all of the beverage stored in the upper receptacle is capable of being dispensed from the beverage dispenser.

DETAILED DESCRIPTION OF THE INVENTION

The present invention is a beverage dispenser that has a dispenser valve extending from the bottom of an upper receptacle and a handle for engaging and activating the valve, a handle that can be readily installed on or removed from the beverage dispenser.

Figure 1:
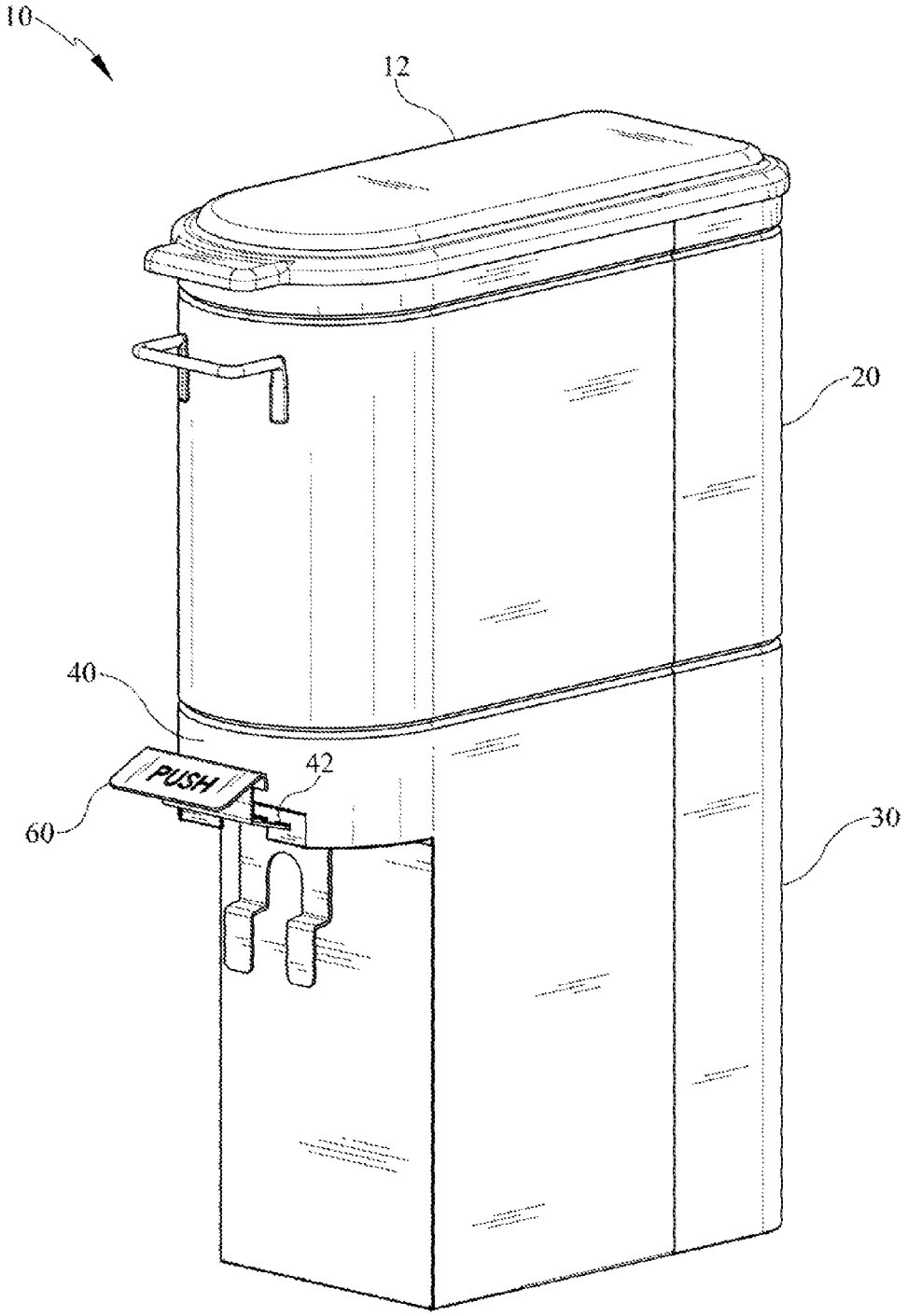
FIG. 1 is a front perspective view of an exemplary beverage dispenser made in accordance with the present invention.
Figure 2:
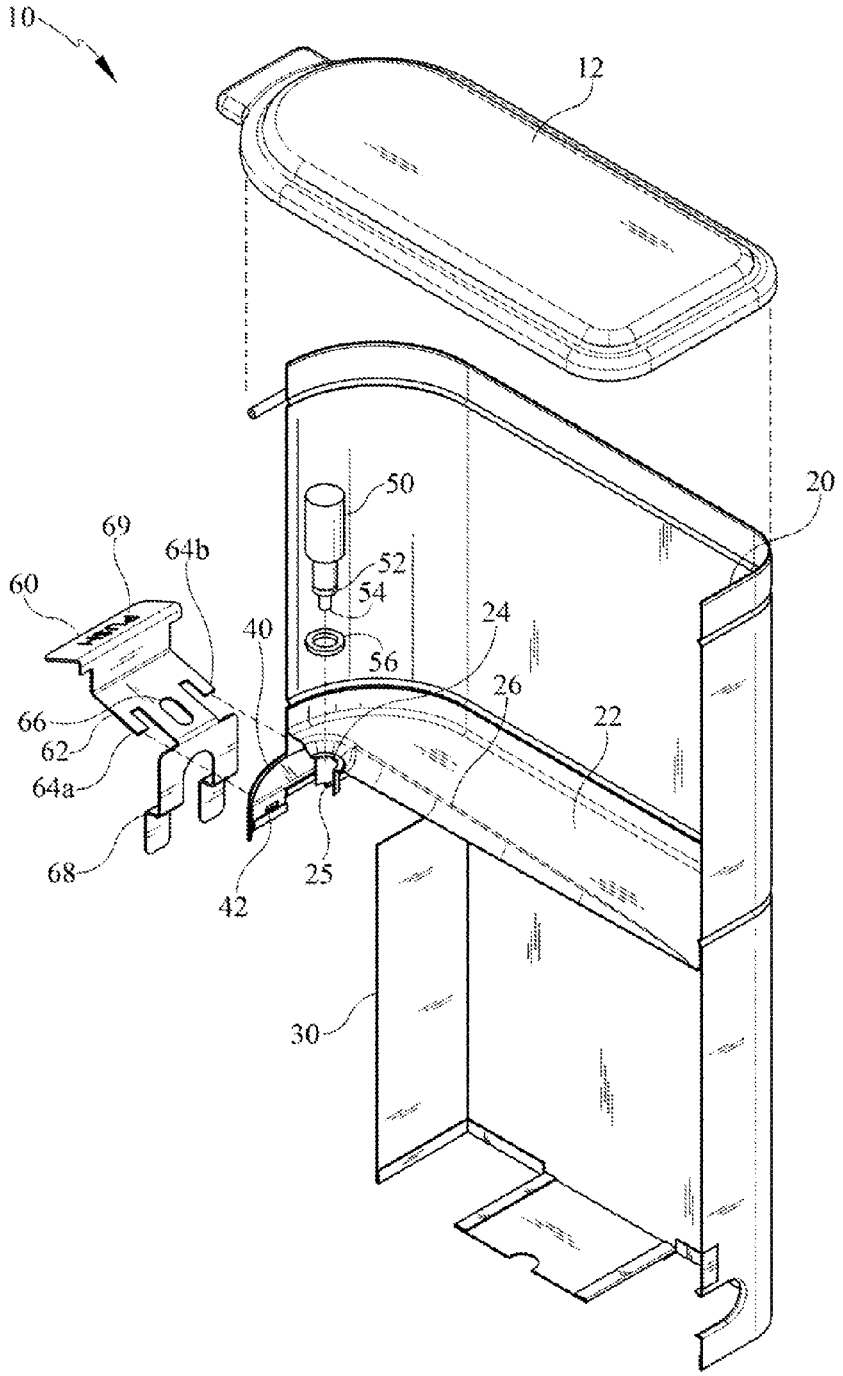
FIG. 2 is a partial exploded perspective view of the exemplary beverage dispenser of FIG. 1, with a lower base and an upper receptacle partially cut away to show the configuration of a handle, a front cover, and a valve of the beverage dispenser.

Referring first to FIGS. 1 and 2, an exemplary beverage dispenser 10 made in accordance with the present invention comprises a lower base 30; an upper receptacle 20 positioned on and above the lower base 30, the upper receptacle 20 for storing a beverage; and a removable lid 12 for closing an open top of the upper receptacle 20. Although these components could be constructed of a number of different materials, when such an exemplary beverage dispenser 10 is used for beverages such as iced tea, the lower base 30 and the upper receptacle 20 are often constructed from metal, such as stainless steel.

Referring still to FIGS. 1 and 2, the upper receptacle 20 includes a bottom panel 22 (shown in FIG. 2), and the lower base 30 is positioned below the bottom panel 22 of the upper receptacle 20. The top surface of the lower base 30 is substantially coplanar to and coextensive with the bottom panel 22 of the upper receptacle 20, except along a front portion of the upper receptacle 20. In other words, the front portion of the upper receptacle 20 extends forward of the lower base 30. In this exemplary embodiment, the beverage dispenser 10 further includes a front cover 40 that is forward of the lower base 30 along the perimeter of the front portion of the upper receptacle 20. Thus, the front cover 40 partially encloses and defines a cavity that is located below the bottom panel 22 of the upper receptacle 20 and forward of the lower base 30, as discussed further below.

Referring now specifically to FIG. 2, the beverage dispenser 10 further includes a valve 50 which is in fluid communication with the beverage stored in the upper receptacle 20 and extends downward from the bottom panel 22 of the upper receptacle 20 substantially within the cavity and adjacent to the lower base 30. The beverage dispenser 10 also includes a handle 60 for engaging the valve 50 to selectively dispense the beverage from the upper receptacle 20. Specifically, the upper receptacle 20 defines an opening 24 extending through the bottom panel 22 of the upper receptacle 20 forward of the lower base 30, and a valve seat 25 is received in and extends downwardly from the opening 24. The valve seat 25 is configured to receive the valve 50, and a gasket 56 or other similar sealing component provides a watertight seal between the valve 50 and the upper receptacle 20 to prevent leakage through the opening 24. In operation, the valve 50 is biased into a closed (downward) position, such that the beverage is maintained in the upper receptacle 20. Upon pushing the valve 50 upward into an open position, beverage that is stored in the upper receptacle 20 is dispensed through the valve 50.

With respect to the construction of the valve 50, although not shown in FIG. 2, the weight of the valve 50 maintains it in the closed position in the valve seat 25. Then, when the valve 50 is moved upward into the open position (i.e., but applying a sufficient upward force to overcome the weight of the valve 50), conduits are exposed within the upper receptacle 20 which allow the passage of beverage from the upper receptacle 20 through the valve 50 and into a cup or other receptacle placed below the valve 50. In other words, the valve 50 includes one or more holes in the side of the valve 50 that lead into such conduits, which holes are located within the valve seat 25 when the valve 50 is in the closed position, but which holes are located above the valve seat 25 when the valve 50 is pushed upward into the open position. Such a valve construction is well-known to a person of ordinary skill in the art, and one suitable valve for use with the beverage dispenser of the present invention is a Crathco® Model 99464 valve available from the present applicant, Grindmaster Corporation d/b/a Grindmaster-Cecilware Corporation of Louisville, Kent. and other third-party parts vendors.

Figure 4:
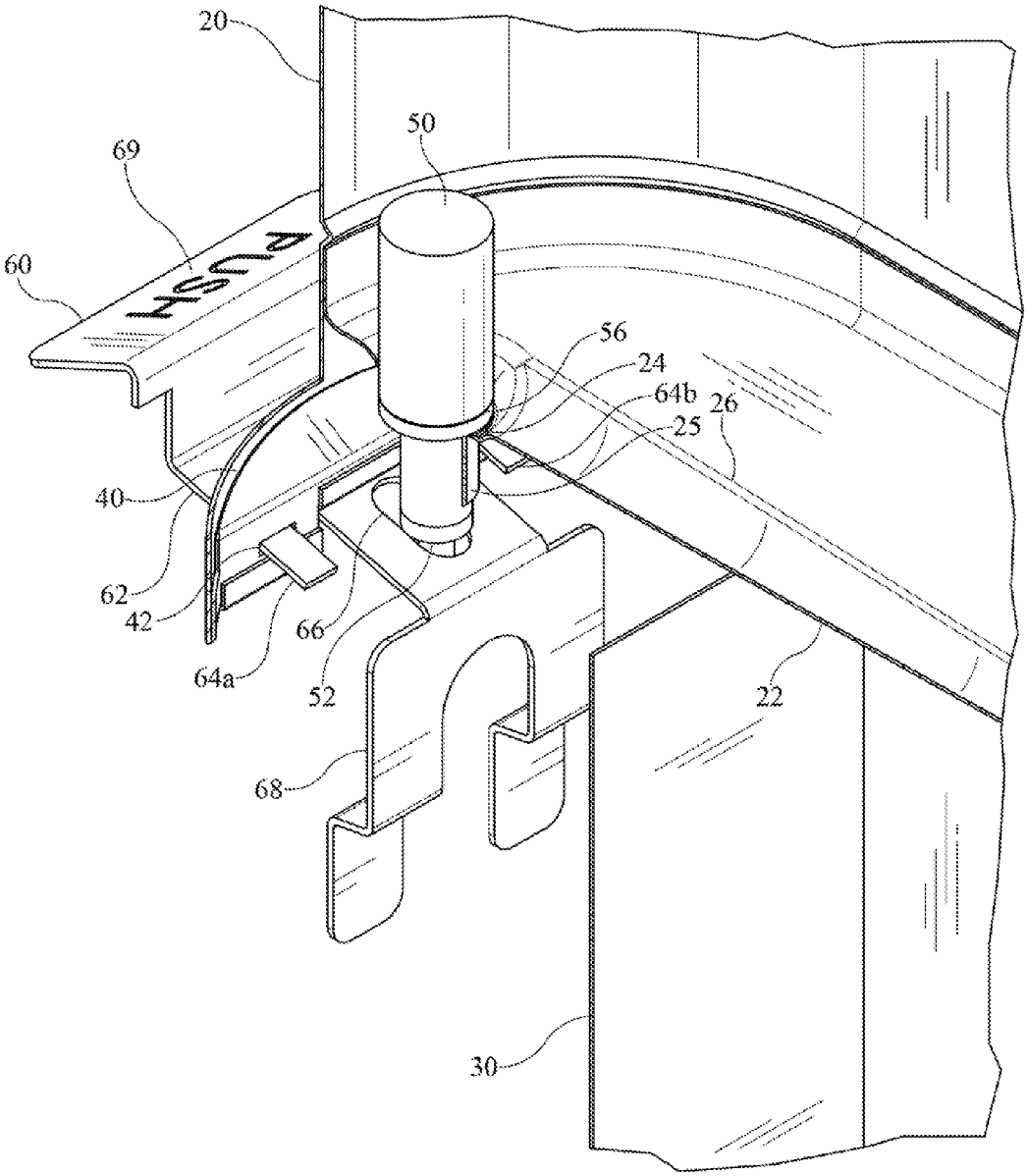
FIG. 4 is an enlarged, partial sectional view of the exemplary beverage dispenser of FIG. 1, showing the interaction of the handle, the front cover, and the valve.

In order to move the valve 50 from the closed to the open position, the handle 60 is configured to rotate relative to the front cover 40 of the beverage dispenser 10 and push the valve 50 upward. The handle 60 is not rigidly connected to the upper receptacle 20, the lower base 30, the front cover 40, or the valve 50, but rather, the handle 60 simply slides onto the front cover 40 and engages the valve 50. To this end, and as shown in FIGS. 1, 2 and 4, the front cover 40 defines a slot 42 on one side of the front cover 40 which is configured to slidably receive an engagement tab 64*a* of the handle 60, as further discussed below. Although not expressly shown, the front cover 40 is substantially symmetrical, and thus, a second slot that is substantially identical to the slot 42 shown in FIGS. 1, 2 and 4 is positioned on the other side of the front cover 40, with the second slot configured to slidably receive another engagement tab 64*b* of the handle 60.

Figure 3:
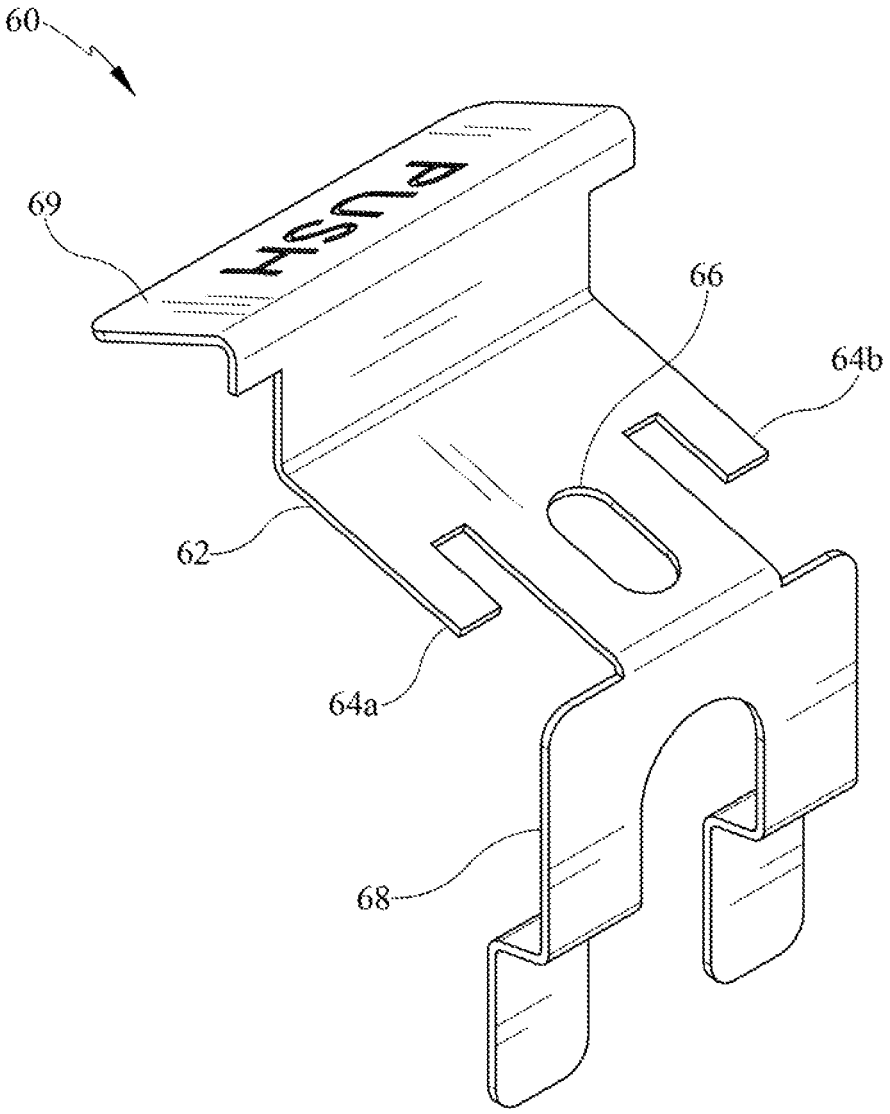
FIG. 3 is an enlarged perspective view of the handle shown in FIG. 2.

With respect to the handle 60, and referring now to FIGS. 2-4, the handle 60 includes a main body plate 62 with two engagement tabs 64*a*, 64*b* (as mentioned above). The handle also defines a central slot 66 that is located between the two engagement tabs 64*a*, 64*b* and is configured to receive the valve 50. As best shown in FIG. 4, the two engagement tabs 64*a*, 64*b* of the handle 60 are slidably received in the two slots 42 defined by the front cover 40, and the valve 50 is received in and engages the central slot 66 defined by the main body plate 62. Specifically, the valve 50 has a distal end 54 that extends through the central slot 66 defined by the main body plate 62, and the valve 50 further includes a circumferential flange 52 which is positioned above and rests on the main body plate 62 when the valve 50 is received in the central slot 66 defined by the main body plate 62. In operation, the main body plate 62 of the handle 60 engages the circumferential flange 52 of the valve 50 to push the valve 50 upward, as further discussed below. As shown in FIG. 4, when the handle 60 and valve 50 are installed, the valve 50 is positioned within the central slot 66, effectively preventing the handle 60 from moving in such a manner that the two engagement tabs 64*a*, 64*b* would slide out of the two slots 42 defined by the front cover 40.

In operation, the exemplary handle 60 shown in FIGS. 1-4 is installed as follows. In the case where the valve 50 is already in place, a user first raises the valve 50 while simultaneously sliding the handle 60 into place. In other words, the handle 60 is slid toward the lower base 30 with the two engagement tabs 64*a*, 64*b* engaging and being received in the two slots 42 defined by the front cover 40. The distal end 54 of the valve 50 slides over the top of the main body plate 62 while the handle 60 is being slid into place. Once the handle 60 is close enough to the lower base 30 that the distal end 54 of the valve 50 is aligned with the central slot 66, the valve 50 is allowed to lower into the central slot 66, and the valve 50 is received in the central slot 66 defined by the main body plate 62, with the circumferential flange 52 of the valve 50 positioned above and resting on the main body plate 62. Of course, in the case where the valve 50 is not present, the handle 60 can simply be slid into place, and the valve 50 then subsequently dropped into place.

In order to remove the exemplary handle 60, any beverage remaining in the upper receptacle 20 is first preferably removed. A user then raises the valve 50 lifting the valve 50 out of the valve seat 25 and out of engagement with the handle 60. The handle 60 is then slid away from the lower base 30 until the two engagement tabs 64*a*, 64*b* slide out of the slots 42 defined by the front cover 40. In the exemplary handle 60 shown in FIGS. 2-4, the central slot 66 is bounded on all sides by the main body plate 62, and, as such, when the valve 50 is received in the central slot 66, the handle 60 is held in place by the valve 50 itself. However, it is contemplated that in other embodiments, the handle could have a central slot that extends to the rear end of the main body plate 62, such that the handle can be installed and removed by simply sliding the handle relative to the lower base 30 even when the valve 50 is received in the central slot.

When the handle 60 is installed and the upper receptacle 20 is filled with a beverage, in order to dispense the beverage, a user causes the main body plate 62 of the handle 60 to rotate upward toward the upper receptacle 20 (i.e., substantially counter-clockwise in FIG. 4). To this end, the handle 60 further includes a rear vertical plate 68 that extends downward from a rear end of the main body plate 62 and also a forward push button 69 that extends upward from a front end of the main body plate 62. Applying a force to the vertical plate 68, or, alternatively, applying a force to the push button 69, causes the handle 60 to rotate in such a manner that the main body plate 62 rotates upward toward the upper receptacle 20. In this way, a user has two options as to how to actuate the handle 60. It is contemplated that the vertical plate 68 could be used with a sturdy receptacle such as, for example, a ceramic mug, by pressing the sturdy receptacle directly against the vertical plate 68. Alternatively, the push button 69 could be used with a weaker or more fragile receptacle, such as, for example, a paper or expanded polystyrene foam cup, in which case the user presses on the push button 69 when the receptacle is positioned beneath the valve 50. Although the vertical plate 68 is shown with two legs that each have a substantially S-shaped cross section, it should be understood that any number of designs and configurations of the vertical plate 68 of the handle 60, including for example, a solid flat panel, could be used without departing from the spirit and scope of the present invention.

As discussed above, in the exemplary beverage dispenser 10, there is a cavity below the bottom panel 22 and forward of the lower base 30, and as perhaps best shown in FIGS. 1 and 4, the valve 50 is positioned substantially within the cavity. Preferably, a space below the cavity is of an adequate size to allow a user to place a receptacle below the valve 50 while operating the handle 60, either by pressing the receptacle against the vertical plate 68 or by pressing on the push button 69 while the receptacle is positioned below the valve 50.

As mentioned above, when the handle 60 is rotated, the main body plate 62 pushes upward on the circumferential flange 52 of the valve 50, and the valve 50 is thus moved upward into the open position. In this exemplary embodiment, the handle 60 will continue to rotate and push the valve 50 upward until the main body plate 62 contacts the valve seat 25.

With respect to the rotation of the handle 60, and referring now specifically to FIG. 4, the two engagement tabs 64*a*, 64*b* of the handle 60 and the respective two slots 42 defined by the front cover 40 are configured to allow the handle 60 to rotate relative to the front cover 40 to engage the valve 50. Specifically, the contact points between the two engagement tabs 64*a*, 64*b* and the two slots 42 act as a pivot for the handle 60 to rotate about an axis generally defined by the intersection of the main body plate 62 of the handle 60 and the front cover 40. As such, it is contemplated that the relative thickness of the front cover 40, the dimensions of the two slots 42 defined by the front cover 40, and the thickness of the two engagement tabs 64*a*, 64*b* are designed to allow adequate rotation of the two engagement tabs 64*a*, 64*b* within the two slots 42 in order to provide the necessary rotation of the handle 60 to appropriately engage the valve 50. More specifically, both the front cover 40 and the handle 60, but, in particular, the two engagement tabs 64*a*, 64*b* of the handle 60, are relatively thin. Furthermore, the two slots 42 are sized so that there is enough clearance between the edges of the slot 42 and the respective engagement tabs 64*a*, 64*b* to allow the engagement tabs 64*a*, 64*b* to freely rotate within the slots 42. Of course, in order for the relatively thin front cover 40 and engagement tabs 64*a*, 64*b* to have the necessary strength to act as the pivot for the handle 60 to overcome the bias (weight) of the valve 50 and move the valve 50 upward into the open position, it is contemplated that the front cover 40, the handle 60, or both are preferably made of metal (such as stainless steel).

Figure 5:
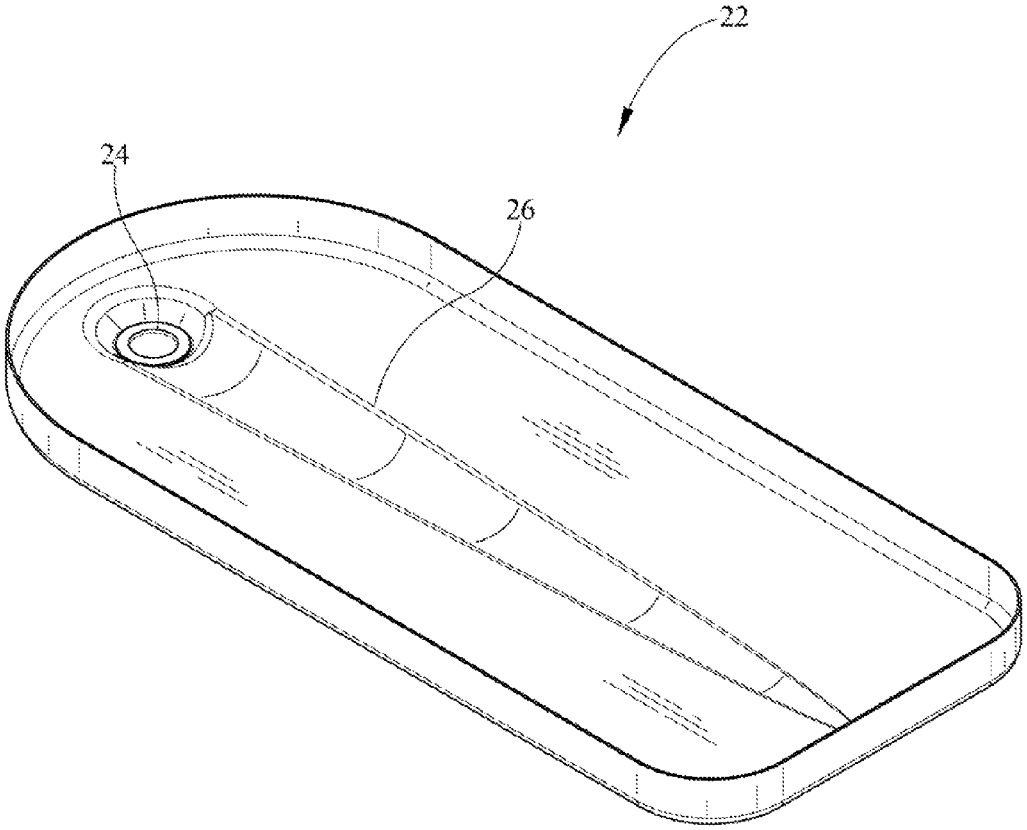
FIG. 5 is a perspective view of the bottom panel of the upper receptacle shown in isolation.

Referring now to FIG. 5, and focusing on the bottom panel 22 of the upper receptacle 20, in this exemplary embodiment, the bottom panel 22 is shaped to direct all of the beverage stored in the upper receptacle 20 toward the opening 24. Specifically, the bottom panel 22 is sloped downward toward the front of the upper receptacle 20. Furthermore, the bottom panel 22 defines a channel 26 along the center of the bottom panel 22 that is directed toward the opening 24, which further facilitates in dispensing the entire volume of beverage stored in the upper receptacle 20. As a result of the unique shape of the bottom panel 22 of the upper receptacle 20, along with the placement of the valve 50 extending from the bottom panel 22 of the upper receptacle 20, all of the beverage stored in the upper receptacle 20 is capable of being dispensed from the beverage dispenser 10.

One of ordinary skill in the art will recognize that additional embodiments are possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A beverage dispenser, comprising:

a lower base;

an upper receptacle positioned on and above the lower base for storing a beverage, said upper receptacle including a front portion that extends forward of the lower base;

a valve in fluid communication with the beverage stored in the upper receptacle and extending downward from a bottom panel of the upper receptacle, said valve being biased into a closed position;

a front cover separate and apart from the upper receptacle that is positioned along the perimeter of the front portion of the upper receptacle and partially encloses and defines a cavity that is located below the bottom panel of the upper receptacle and forward of the lower base; and a handle pivotally connected to the front cover and engaging the valve, wherein, rotation of the handle causes the handle to move the valve from the closed position to an open position.

2. The beverage dispenser as recited in claim 1, wherein the handle slidably engages the front cover.

3. The beverage dispenser as recited in claim 2, wherein the handle includes two engagement tabs, wherein the front cover defines two slots configured to slidably receive the two engagement tabs of the handle, and wherein rotation of the handle is about a pivot axis defined by an intersection of the handle with the front cover.

4. The beverage dispenser as recited in claim 1, wherein the handle includes a main body plate that (a) includes two engagement tabs which are configured for engagement with the front cover and (b) defines a central slot which receives the valve, wherein the valve includes a circumferential flange positioned above the main body plate when the valve is received in the central slot defined by the main body plate, such that, upon rotating the handle about a pivot axis defined by an intersection of the main body plate of the handle and the front cover, the main body plate pushes upward on the circumferential flange, which moves the valve into the open position.

5. A beverage dispenser, comprising:

a lower base constructed from metal;

an upper receptacle constructed from metal and positioned on and above the lower base for storing a beverage, said upper receptacle including a front portion that extends forward of the lower base, and said upper receptacle defining an opening extending through a bottom panel of the upper receptacle;

a valve in fluid communication with the beverage stored in the upper receptacle, wherein said valve is seated within the opening defined through the bottom panel of the upper receptacle and extends downward from the upper receptacle, and wherein said valve is biased into a closed position;

a front cover that partially encloses and defines a cavity that is located below the bottom panel of the upper receptacle and forward of the lower base, the front cover defining two slots; and a handle engaging the valve and including two engagement tabs, wherein the two slots of the front cover slidably receive the two engagement tabs to allow rotation of the handle, and wherein, rotation of the handle about a pivot axis defined by an intersection of the handle with the front cover causes the handle to move the valve from the closed position to an open position.

6. The beverage dispenser as recited in claim 5, wherein the bottom panel of the upper receptacle is sloped downward toward the opening defined through the bottom panel of the upper receptacle.

7. The beverage dispenser as recited in claim 5, wherein the bottom panel defines a central channel directed toward the opening defined through the bottom panel of the upper receptacle.

8. The beverage dispenser as recited in claim 5, wherein the handle includes a main body plate that defines a central slot which receives the valve, wherein the valve includes a circumferential flange positioned above the main body plate when the valve is received in the central slot defined by the main body plate, such that, upon rotating the handle, the main body plate pushes upward on the circumferential flange, which moves the valve into the open position.

9. A beverage dispenser, comprising:

a lower base;

an upper receptacle positioned on and above the lower base for storing a beverage, said upper receptacle including a front portion that extends forward of the lower base, and said upper receptacle defining an opening extending through a bottom panel of the upper receptacle;

a valve in fluid communication with the beverage stored in the upper receptacle, wherein said valve is seated within the opening defined through the bottom panel of the upper receptacle and extends downward from the upper receptacle, and wherein said valve is biased into a closed position;

a front cover that partially encloses and defines a cavity that is located below the bottom panel of the upper receptacle and forward of the lower base, said front cover defining two slots;

a handle pivotally connected to the front cover and engaging the valve, wherein the handle includes a main body plate that (a) includes two engagement tabs which are configured for engagement with the front cover and (b) defines a central slot which receives the valve, wherein the valve includes a circumferential flange positioned above the main body plate when the valve is received in the central slot defined by the main body plate, such that, upon rotating the handle about a pivot axis defined by an intersection of the handle with the front cover, the main body plate pushes upward on the circumferential flange, which moves the valve from the closed position to an open position.

10. The beverage dispenser as recited in claim 9, wherein the bottom panel of the upper receptacle is sloped downward toward the opening defined through the bottom panel of the upper receptacle.

11. The beverage dispenser as recited in claim 9, wherein the bottom panel defines a central channel directed toward the opening defined through the bottom panel of the upper receptacle.

* * * * *